US010480207B1

(12) United States Patent
Webster

(10) Patent No.: US 10,480,207 B1
(45) Date of Patent: Nov. 19, 2019

(54) POST GUARD

(71) Applicant: Gary P. Webster, Palm Harbor, FL (US)

(72) Inventor: Gary P. Webster, Palm Harbor, FL (US)

( * ) Notice: Subject to any disclaimer, the term of this patent is extended or adjusted under 35 U.S.C. 154(b) by 0 days.

(21) Appl. No.: 16/231,421

(22) Filed: Dec. 22, 2018

(51) Int. Cl.
*E04H 12/22* (2006.01)
*E01F 15/04* (2006.01)

(52) U.S. Cl.
CPC ..... *E04H 12/2292* (2013.01); *E01F 15/0469* (2013.01)

(58) Field of Classification Search
CPC ..... E04H 12/2292; E01F 15/0469
See application file for complete search history.

(56) References Cited

U.S. PATENT DOCUMENTS

| | | | | |
|---|---|---|---|---|
| 135,685 | A | 2/1873 | Ayers | |
| 145,585 | A | 12/1873 | Neff | |
| 223,093 | A | 12/1879 | Barnhill et al. | |
| 254,135 | A | 2/1882 | Hornung et al. | |
| 283,837 | A | 8/1883 | Wallace | |
| 404,757 | A | 6/1889 | Webber | |
| 561,391 | A | 6/1896 | Greene | |
| 727,054 | A | 5/1903 | Arndt | |
| 1,251,786 | A | 1/1918 | Kirfman | |
| 1,517,846 | A | 12/1924 | Lewis | |
| 1,999,098 | A * | 4/1935 | Hillyer | E04H 12/2292 52/98 |
| D162,243 | S | 2/1951 | Simmons | |
| 3,562,403 | A * | 2/1971 | Monahan | F21V 21/108 174/45 R |
| 4,516,756 | A | 5/1985 | Beatty | |
| 574,998 | A | 1/1987 | Kent et al. | |
| 4,815,235 | A | 3/1989 | Faltinowski | |
| 4,845,889 | A | 7/1989 | Taylor | |
| 5,044,815 | A | 9/1991 | Wright | |
| 5,503,371 | A | 4/1996 | Bies | |
| 5,661,925 | A | 9/1997 | MacMaster | |
| 5,782,041 | A | 7/1998 | Filipescu | |
| 5,800,727 | A | 9/1998 | Croghan | |
| D403,929 | S | 1/1999 | Evans | |

(Continued)

FOREIGN PATENT DOCUMENTS

| | | | |
|---|---|---|---|
| DE | 3433929 | A1 | 3/1986 |
| DE | 9110154 | U1 | 10/1991 |

(Continued)

*Primary Examiner* — Rodney Mintz
(74) *Attorney, Agent, or Firm* — Larson & Larson, P.A.; Frank Liebenow; Justin P. Miller

(57) ABSTRACT

A post guard includes a first upright portion and a second upright portion. A first edge of the first upright portion is hingedly connected to a first edge of a second upright portion. A first section of a locking mechanism is on a second edge of the left portion (the second edge of the left portion distal from the first edge of the left portion) and a second section of the locking mechanism is on a second edge of the right portion, the second edge of the right portion distal from the first edge of the right portion. The locking mechanism secures the post guard to a post and once the locking mechanism is locked, the post guard remains on the post until the post guard is broken. The post guard has a size and a shape to conform and fit closely around the fence post.

13 Claims, 5 Drawing Sheets

(56) References Cited

U.S. PATENT DOCUMENTS 5,956,920 A * 9/1999 Davis ..... E04C 3/30 52/236.1
6,242,070 B1 * 6/2001 Gillispie ..... E01F 15/141 428/122
6,257,557 B1 7/2001 Anderson et al.
6,364,575 B1 * 4/2002 Bradley ..... E02B 17/0026 405/216
6,553,726 B1 4/2003 Roberts
6,773,206 B2 * 8/2004 Bradley ..... E02B 17/0026 405/215
7,104,525 B2 9/2006 Ricci
7,470,091 B2 * 12/2008 Scholl ..... E02D 27/42 405/229
7,946,052 B2 5/2011 Stevens
8,443,576 B2 * 5/2013 Petta ..... E04C 3/30 52/579
8,533,991 B2 9/2013 Lais et al.
9,732,485 B2 * 8/2017 McCue ..... E04C 3/36
9,920,519 B2 * 3/2018 Ryan ..... E04B 1/92
10,227,774 B2 * 3/2019 Ryan ..... E04B 1/92
2001/0022056 A1 * 9/2001 Gifford ..... E04F 13/0736 52/311.1
2002/0094239 A1 * 7/2002 Bradley ..... E02B 17/0026 405/216
2003/0085482 A1 * 5/2003 Sincock ..... E02D 5/64 264/32
2005/0005540 A1 * 1/2005 Nesbitt ..... E04H 12/2292 52/169.9
2007/0138452 A1 6/2007 Donabedian
2007/0224002 A1 * 9/2007 Scholl ..... E02D 27/42 405/231
2010/0200823 A1 8/2010 Ringus et al.
2012/0228572 A1 9/2012 Carswell
2012/0324826 A1 * 12/2012 Petta ..... E04C 3/30 52/834
2014/0182226 A1 * 7/2014 Habodasz ..... E04F 13/0736 52/309.1
2015/0167311 A1 * 6/2015 Mingyong ..... E04F 13/07 52/509
2015/0176298 A1 6/2015 Carswell
2016/0215464 A1 * 7/2016 McCue ..... E04C 3/36
2016/0222648 A1 * 8/2016 Ryan ..... E04B 1/92

FOREIGN PATENT DOCUMENTS

DE 8437812 U1 9/1993
DE 9401712 U1 3/1994

* cited by examiner

POST GUARD

FIELD

This invention relates to the field of posts and more particularly to a system for protecting posts such as fence posts, sign posts, mailbox posts, etc.

BACKGROUND

There are many posts used throughout the world for supporting various objects such as fences, signs, and mailboxes. Often, such posts are made of wood such as a four-inch by four-inch wooden post, but sometimes such posts are made of metal, plastic, or any other sturdy material.

Many such posts find uses on or abutting a lawn or other area that must be maintained. Maintenance of such areas/lawns often includes mowing and trimming, the later performed with the use of a device commonly known as a weed whacker. The maintenance of such areas/lawns often results in marring of the posts, especially at the bottom few inches of the posts, as lawn mowers hit or rub against the posts and the cutting cord of the weed whackers chips, marks, or digs into the posts.

Many people take pride in the beauty of their landscape and find a marred post to be unattractive. Further, some posts are reused over and over (e.g. sign posts used by real estate agents) and a worn, marred post does not make a good impression for a potential buyer/renter.

In the past, when these posts become unsightly, the typical solution was to replace the post with a new post which is expensive and hurtful to the ecology as many posts are made from pressure treated wood that contains harmful chemicals. Further, many people are not able to replace such posts without the help of a worker, requiring even more expense.

What is needed is a system that will attach to an existing post and cover the bottom section of the post, protecting and enhancing the look of the post.

SUMMARY

A post guard is describe made of s durable material that is fitted to and surrounds a lower portion of a post where posts are often marred and damaged from lawn maintenance devices. The post guard holds tight to the post and lock in place to reduce any potential theft by removal.

In one embodiment, a post guard is disclosed including a first upright portion and a second upright portion. A first edge of the first upright portion is hingedly connected to a first edge of a second upright portion. A locking mechanism is provided. A first section of the locking mechanism is on a second edge of the left portion (the second edge of the left portion distal from the first edge of the left portion) and a second section of the locking mechanism is on a second edge of the right portion, the second edge of the right portion distal from the first edge of the right portion. The locking mechanism secures the post guard to a post and once the locking mechanism is locked, the post guard remains on the post until the post guard is broken. The post guard has a size and a shape to conform and fit closely around the fence post.

In another embodiment, a method of repairing a marred post using a post guard is disclosed including spreading a first upright portion of the post guard apart from a second upright portion of the post guard along a hinge. A first edge of the first upright portion is hingedly connected to a first edge of the second upright portion. Wrapping the post guard around a post in an area where the post is marred and then locking the post guard to the post by inserting each of a plurality of conical shaped protrusions affixed to an inside of the second edge of the left portion (the second edge of the left portion distal from the first edge of the left portion) into a corresponding hole formed on the second edge of the right portion. The corresponding hole is slightly smaller than a largest circumference of the conical shaped protrusion such that, after inserting the conical shaped protrusions into the corresponding hole, the conical shaped protrusion prevents removal of the conical shaped protrusion from the corresponding hole. This locks the second edge of the left portion to the second edge of the right portion.

In another embodiment, a post guard is disclosed. The post guard has a size and a shape to conform and fit closely around a fence. The post guard includes a first upright portion that has a first edge that is hingedly connected to a first edge of a second upright portion. A locking mechanism has a plurality of conical shaped protrusions affixed to an inside of the second edge of the left portion (the second edge of the left portion being distal from the first edge of the left portion). The locking portion also has a plurality of corresponding holes formed on the second edge of the right portion. The holes are slightly smaller than a largest circumference of a corresponding conical shaped protrusion such that, after insertion of each the conical shaped protrusion into one of the plurality of corresponding holes, the conical shaped protrusion prevents removal, thereby locking the second edge of the left portion to the second edge of the right portion. The locking mechanism secures the post guard to a post and once the locking mechanism is locked, the post guard remains on the post until the post guard is broken.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
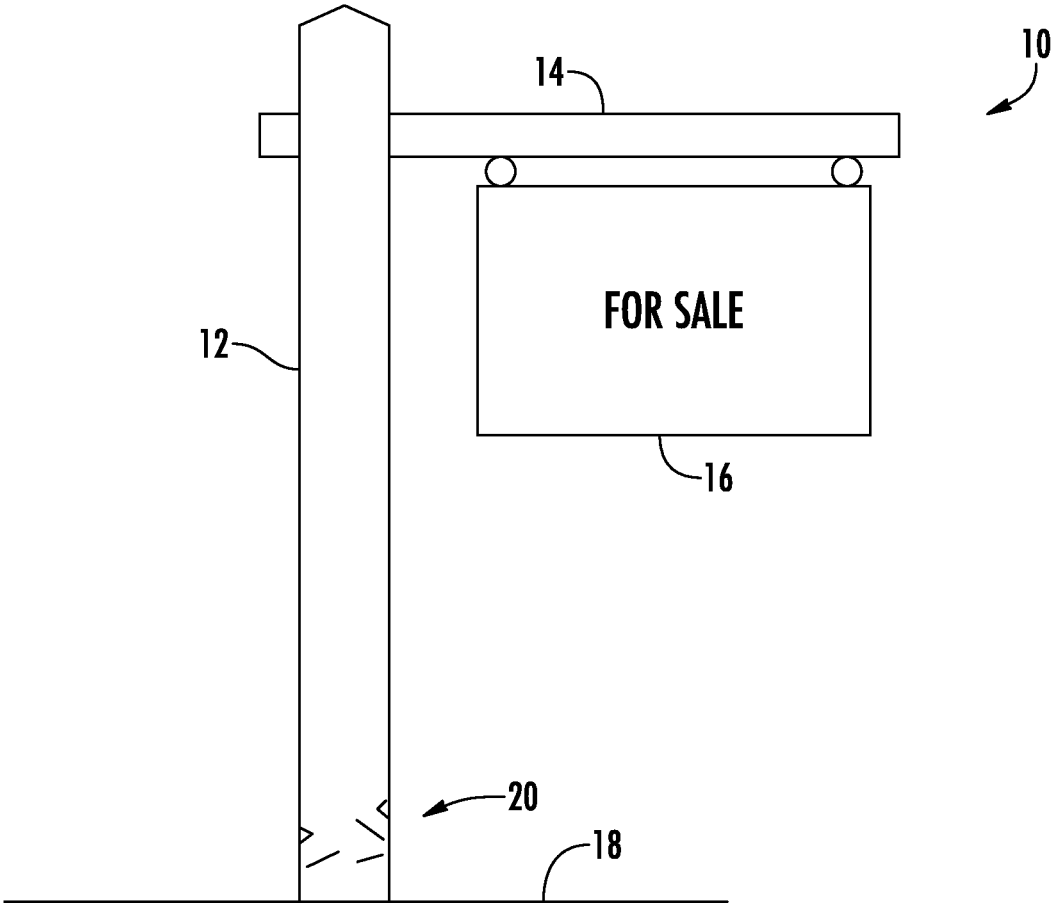
FIG. 1 (PRIOR ART)
FIG. 1 illustrates a view of a post of the prior art.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a view of a post 12 of the prior art is shown. As discussed in the background, posts 12 such as fence posts, sign posts 10, mailbox posts, etc., are often nicked, marred, or damaged in any of many ways, for example, the damage 20 shown in FIG. 1. Note that such damage 18 is usually caused by lawn maintenance equipment such as lawn mowers, weed whackers, etc. Note that some communities require a specific type and color of post 12 and often require certain levels of lawn maintenance and material quality, often leading to issues regarding posts 12 that have damage 20.

For completeness, the sign post 10 includes a sign post extension 14 is shown supporting a sign 16.

Figure 2:
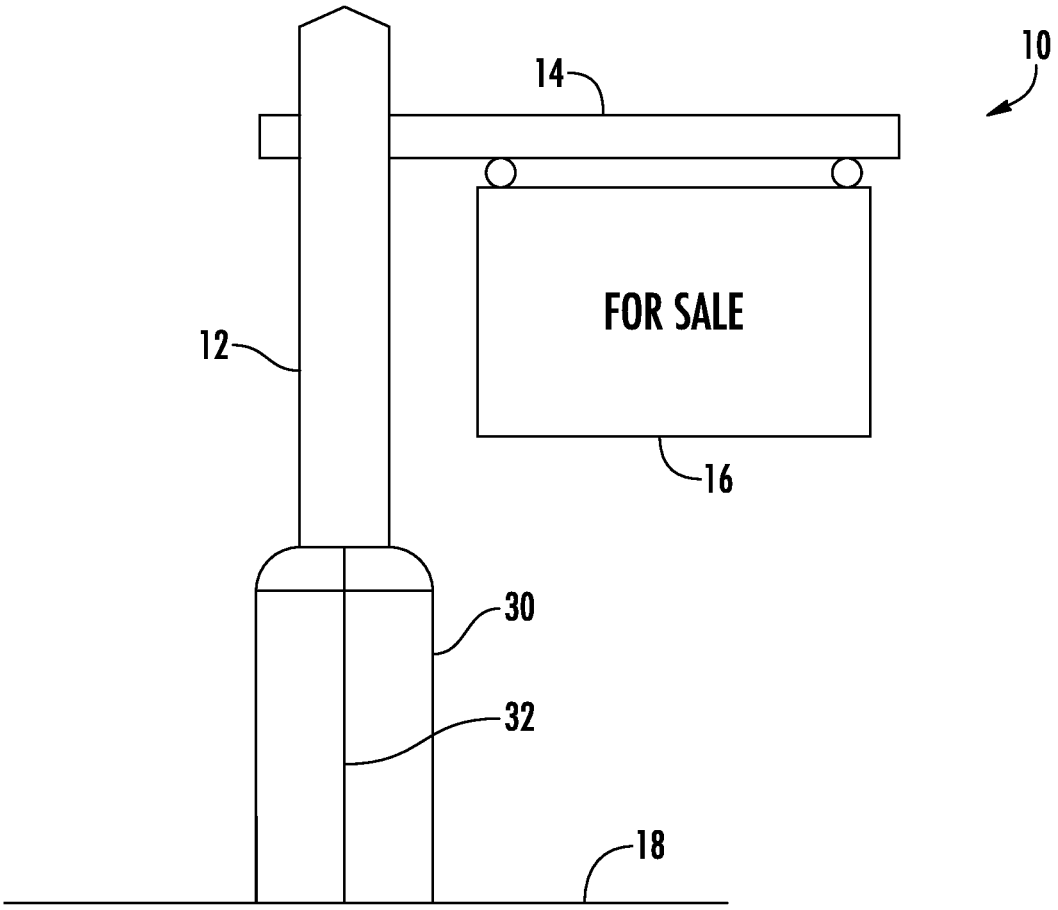
FIG. 2 illustrates a view of the post of FIG. 1 equipped with a post guard.

Referring to FIG. 2, a view of the post 12 of FIG. 1 equipped with a post guard 30 is shown. As discussed above, the post 12 (e.g. a sign post 10) is often nicked, marred, or damaged in any of many ways, for example, the damage 20 shown in FIG. 1. In FIG. 2, the damage 20 is now covered by the post guard 30. Although the post guard 30 is shown covering the post 12 of FIG. 1, there is no requirement that the post guard 30 be fitted to a post 12 that is nicked, marred, or damaged as it is fully anticipated that the post guard 30 be fitted to a post 12 that is new or recently installed and in perfect shape.

In the view of FIG. 2, the hinge 32 of the post guard 30 is visible. The hinge 32, preferably a living hinge, allows for opening of the post guard 30 during installation so that the post guard 30 extends around the post 12 before the post guard 30 is closed and locked. The post guard 30 is sized and a shaped to conform and fit closely around the post 12. In some embodiments, the outer shape of the post guard 30 is substantially cylindrical.

Figure 3A:
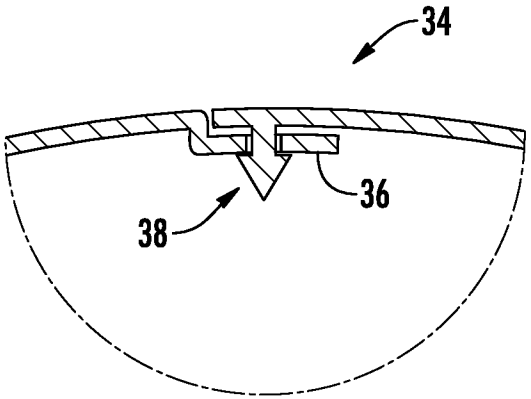
FIGS. 3A and 3B illustrate an exemplary locking mechanism of the post guard, shown locked in FIG. 3A and open, before locking, in FIG. 3B.
Figure 3B:
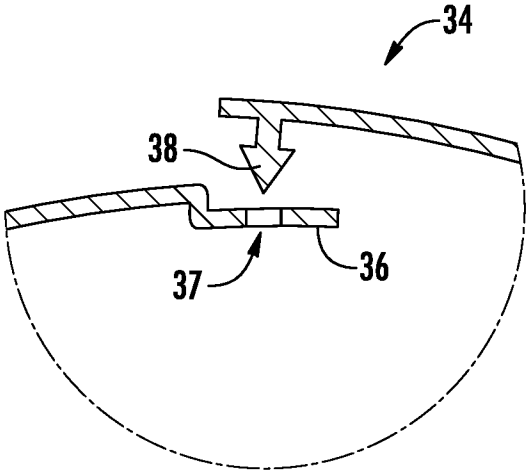
Figure 3:
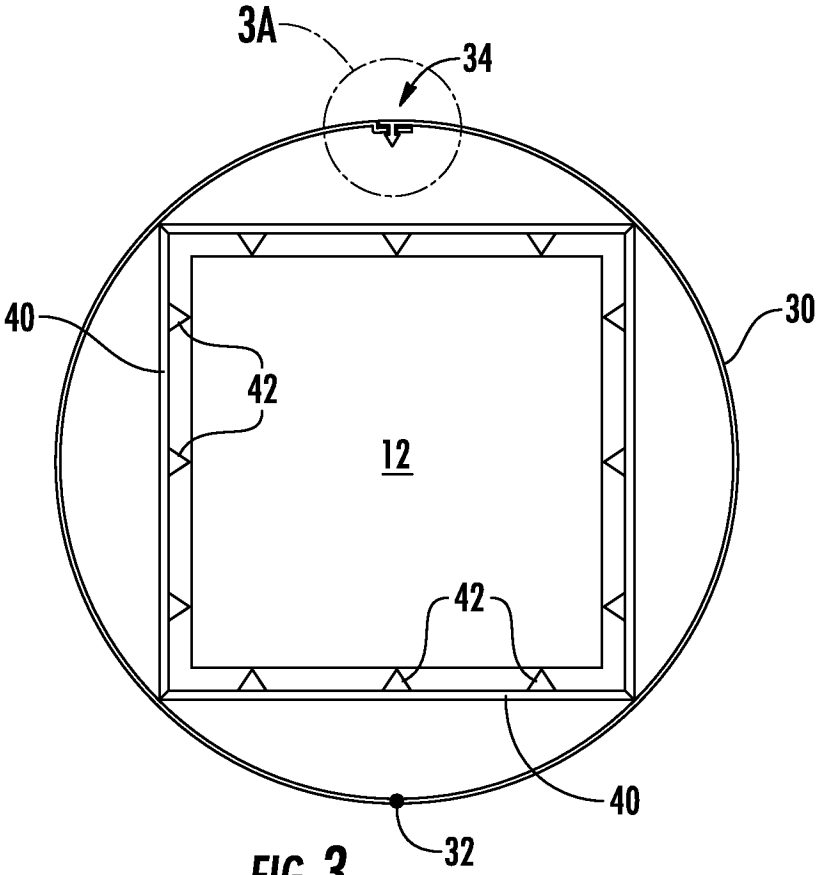
FIG. 3 illustrates a top cut-away view of the post guard.

Referring to FIG. 3, a top cut-away view of the post guard 30 is shown. In the view of FIG. 3, the hinge 32 of the post guard 30 is shown on a surface of the post guard 30 that directly opposes the locking mechanism 34. The hinge 32 connects two upright portions of the post guard 30.

Note that it is fully anticipated to locate the hinge 32 of the post guard 30 on any surface of the post guard 30, not necessarily opposing the locking mechanism 34. The hinge 32, preferably a living hinge, allows for opening of the post guard 30 during installation so that the post guard 30 extends around the post 12 before the post guard 30 is closed and locked in place using the locking mechanism 34.

Also visible in FIG. 3 are the optional barbs 42 that are supported by lateral members 40. The lateral members interface to the post guard 30. The optional barbs 42 push against/into the post 12 to help maintain a position of the post guard 30, after the post guard 30 is locked in place about the post 12.

It has been found that post guards of the prior art either fall off or are taken by others. To prevent theft, the post guard 30 locks onto the post 12 so that, short of destroying the post guard 30, the post guard 30 cannot be removed. As shown, the post guard 30 locks together by locking mechanisms that makes it difficult to remove the post guard 30 without destroying the post guard 30, In the example shown in detail in FIGS. 3A and 3B, the locking mechanism consists of conical protrusions 38 that are pushed into holes 37 that are slightly smaller than the largest diameter of the conical protrusions 38 such that, after forcing the largest diameter of the conical protrusion 38 through the holes 37, it is almost impossible to remove the conical protrusions 38 from the holes 37 without destroying the post guard 30. In such, a largest diameter of a conical protrusion 38 (a protrusion that has a conical shape, e.g., a conical shaped protrusion) is greater than a diameter of a corresponding one of the holes 37. Due to resiliency of the conical protrusion 38 and/or the hole 37, the conical protrusion 38 is "snapped" into the hole 37 and, once inserted into the hole 37, the conical protrusion 38 cannot be removed without destroying the post guard 30.

In some embodiments, the holes 37 are formed on an indented surface 36 of the post guard 30 so that, when the conical protrusions 38 on an edge 33 of the post guard 30 mate with the corresponding holes 37 on the indented surface 36, the edge 33 overlaps the indented surface 36, leaving a smooth conical outer surface for the post guard 30.

Although the locking mechanism 34 is shown having conical protrusions 38 that mate with holes 37, the present invention is not limited in any way to any particular locking mechanism.

Note that although the post guard 30 is shown having a substantially conical shape, other shapes are anticipated including those having rectangular cross sections, oval cross sections, hexagonal cross sections, etc.

Figure 4:
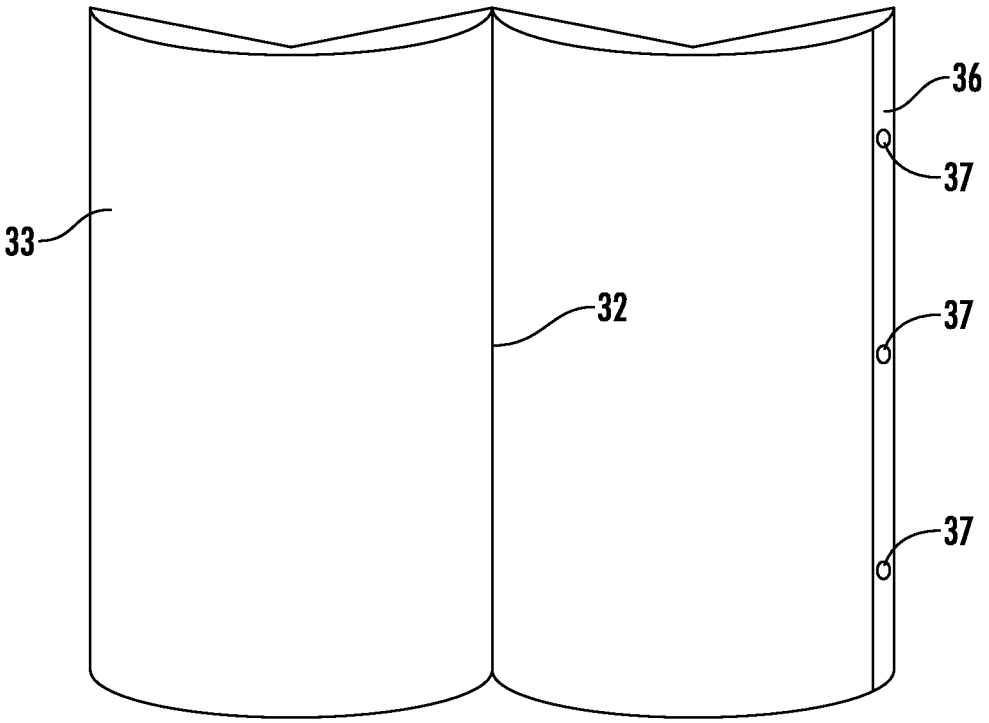
FIG. 4 illustrates a front view of the post guard in an open configuration.

Referring to FIG. 4, a front view of the post guard 30 in an open configuration is shown. The view of FIG. 4 shows the post guard 30 before installation on a post 12. The conical protrusions 38 are not visible as they are covered by the edge 33 of the post guard 30, but the holes 37 along the indented surface 36 are visible. Note that although three holes 37 are shown, any number of holes 37 are anticipated, including one hole 37.

The hinge 32 is bent open, allowing the post guard 30 to be wrapped around a post 12 for installation.

Figure 5:
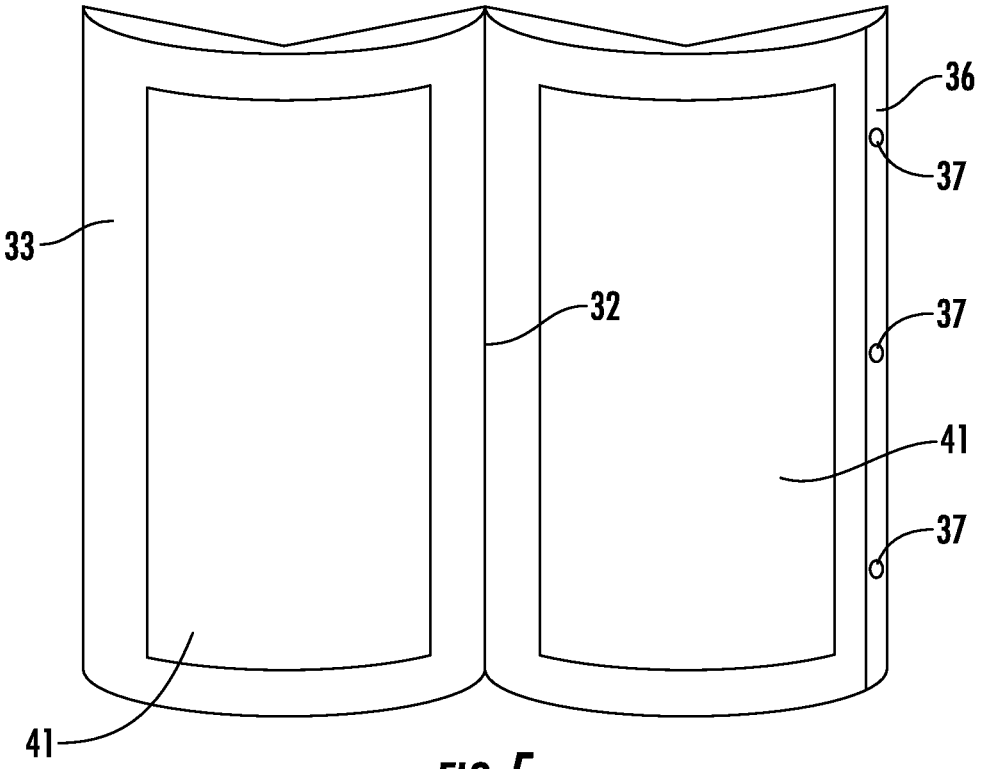
FIG. 5 illustrates a front view of the post guard having a metallic cover in an open configuration.

Referring to FIG. 5, a front view of the post guard 30 having an optional metallic cover 41 in an open configuration is shown. The view of FIG. 4 shows the post guard 30 with the optional metallic cover 41 is shown before installation on a post 12. The conical protrusions 38 are not visible as they are covered by the edge 33 of the post guard 30, but the holes 37 along the indented surface 36 are visible. Note that although three holes 37 are shown, any number of holes 37 are anticipated, including one hole 37. The optional metallic cover 41 provides a surface that is more difficult to damage or mar after installation (e.g. by lawn maintenance equipment, pets, etc.). One example of the optional metallic cover 41 is a optional metallic cover made of a thin sheet of stainless steel. The optional metallic cover 41 is either bonded to the post guard 30 or fitted into catches that snap around the optional metallic cover 41, holding the optional metallic cover 41 in place as shown in FIG. 5.

As in FIG. 4, the hinge 32 is bent open, allowing the post guard 30 to be wrapped around a post 12 for installation.

Figure 6:
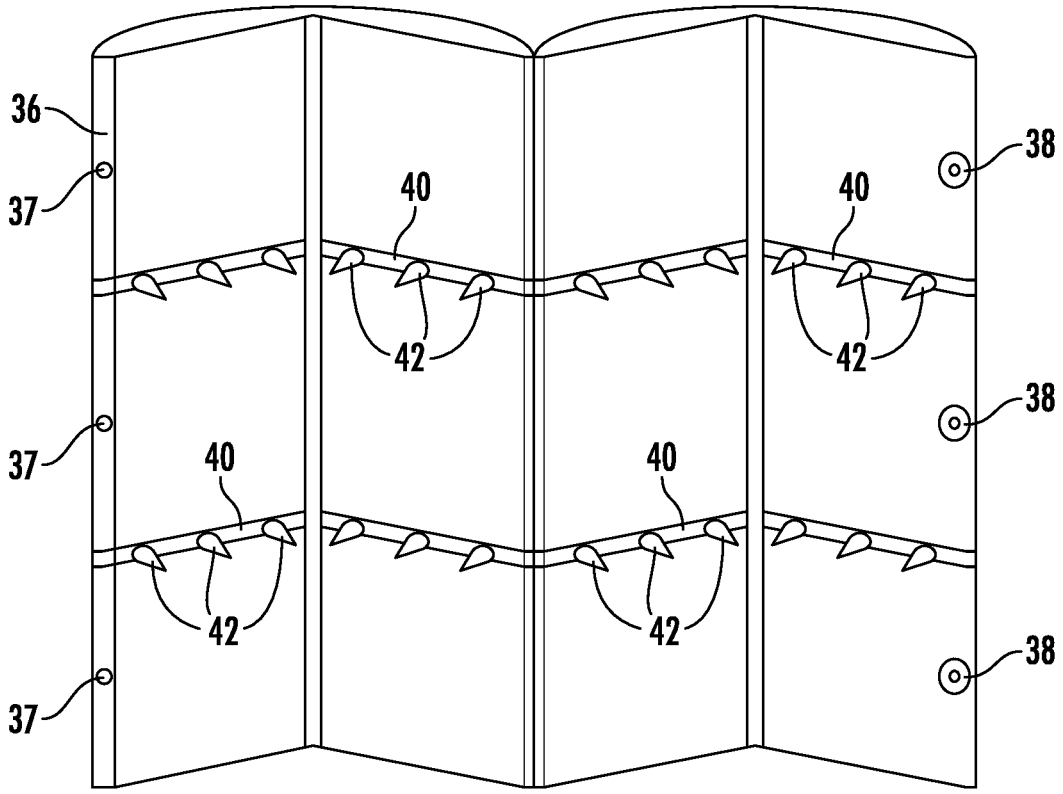
FIG. 6 illustrates a rear view of the post guard showing internal configurations.

Referring to FIG. 6, a rear view of the post guard 30 showing internal configurations is shown. In this view, the locking mechanism 34 is visible with conical protrusions 38 and holes 37 on the indented surface 36. The conical protrusions 38 correspond and align with the holes 37 such that, when the post guard 30 is fitted around a post 12 and closed (bent closes at the hinge 32), the conical protrusions 38 match up with the holes 37 and the conical protrusions 38 are inserted into the holes 37 for locking.

Also visible in FIG. 6 are the optional barbs 42 that are supported by lateral members 40. The lateral members interface to or are formed with an inside surface of the post guard 30. The optional barbs 42 push against/into the post 12 to help maintain a position of the post guard 30, after the post guard 30 is locked in place about the post 12. Not that several rows of the optional barbs 42 are shown as any number of rows of the optional barbs are anticipated, including zero and one row.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A post guard comprising:

a first upright portion, a first edge of the first upright portion hingedly connected to a first edge of a second upright portion by a living hinge; and a locking mechanism, a first section of the locking mechanism located on a second edge of the first upright portion, the second edge of the first upright portion distal from the first edge of the first upright portion; and a second section of the locking mechanism located on a second edge of the second upright portion, the second edge of the second upright portion distal from the first edge of the second upright portion;

wherein the locking mechanism secures the post guard to a post and once the locking mechanism is locked, the post guard remains on the post until the post guard is broken;

wherein the post guard has a size and a shape to conform and fit closely around the post: and wherein the post guard is a unitary structure of single-piece construction.

2. The post guard of claim 1, wherein the outer shape of the post guard is cylindrical.

3. The post guard of claim 1, wherein the locking mechanism comprises a plurality of conical shaped protrusions affixed to an inside of the second edge of the first upright portion and a plurality of corresponding holes formed on the second edge of the second upright portion, the holes are slightly smaller than a largest circumference of a corresponding conical shaped protrusion such that, after insertion of each conical shaped protrusion into one of the plurality of corresponding holes, the conical shaped protrusion prevents removal, thereby locking the second edge of the first upright portion to the second edge of the second upright portion.

4. The post guard of claim 1, further comprising a plurality of barbs on an inside surface of the post guard, the barbs interfacing with the fence post after the post guard is installed onto the fence post, thereby impeding movement of the post guard along an axis of the fence post.

5. The post guard of claim 1, further comprising a metallic cover on an outside surface of each of the upright portions.

6. A post guard comprising:

a first upright portion, a first edge of the first upright portion hingedly connected to a first edge of a second upright portion by a living hinge; and a locking mechanism comprising a plurality of conical shaped protrusions affixed to an inside of a second edge of the first upright portion, the second edge of the first upright portion distal from the first edge of the first upright portion, and a plurality of corresponding holes formed on a second edge of the second upright portion, the holes are slightly smaller than a largest circumference of a corresponding said conical shaped protrusion such that, after insertion of each said conical shaped protrusion into one of the plurality of corresponding holes, the conical shaped protrusion prevents removal, thereby locking the second edge of the first upright portion to the second edge of the second upright portion;

wherein the locking mechanism secures the post guard to a post and once the locking mechanism is locked, the post guard remains on the post until the post guard is broken; and wherein the post guard has a size and a shape to conform and fit closely around the post.

7. The post guard of claim 6, wherein the outer shape of the post guard is cylindrical.

8. The post guard of claim 6, further comprising a plurality of barbs on an inside surface of the post guard, the barbs interfacing with the fence post after the post guard is installed onto the fence post, thereby impeding movement of the post guard along an axis of the fence post.

9. The post guard of claim 6, further comprising a metallic cover on an outside surface of each of the upright portions.

10. A method of covering a post that has been marred using a post guard, the method comprising:

spreading a first upright portion of the post guard apart from a second upright portion of the post guard along a living hinge, a first edge of the first upright portion being hingedly connected to a first edge of the second upright portion;

wrapping the post guard around a post in an area where the post is marred; and locking the post guard to the post by inserting each of a plurality of conical shaped protrusions affixed to an inside of a second edge of the first upright portion, the second edge of the first upright portion distal from the first edge of the first upright portion, into a corresponding hole formed on a second edge of the second upright portion, the corresponding hole being slightly smaller than a largest circumference of the conical shaped protrusion such that, after inserting the conical shaped protrusions into the corresponding hole, the conical shaped protrusion preventing removal of the conical shaped protrusion from the corresponding hole, thereby locking the second edge of the first upright portion to the second edge of the second upright portion.

11. The method of claim 10, wherein an outer shape of the post guard is cylindrical.

12. The method of claim 10, further comprising:

limiting movement of the post guard on the post by, after locking the post guard to the post, a plurality of barbs that are interfaced to an inside surface of the post guard digging into the post.

13. The method of claim 10, further comprising:

protecting the post guard from marring by affixing a metallic cover to an outer surface of the post guard.

* * * * *